United States Patent [19]

Schär

[11] 4,036,446

[45] July 19, 1977

[54] METHOD AND APPARATUS FOR BRAKING A BOBBIN CHUCK AND FOR RELEASING A BOBBIN TUBE THEREON

[75] Inventor: Hugo Schär, Dattlikon, Switzerland

[73] Assignee: Rieter Machine Works, Ltd., Winterthur, Switzerland

[21] Appl. No.: 617,235

[22] Filed: Sept. 26, 1975

[30] Foreign Application Priority Data

Oct. 9, 1974 Switzerland ..... 13554/74

[51] Int. Cl.[2] ..... B65H 63/08

[52] U.S. Cl. ..... 242/39; 242/18 DD; 242/46.4

[58] Field of Search ..... 242/36, 39, 18 DD, 46.2, 242/46.4

[56] References Cited

U.S. PATENT DOCUMENTS

| | | | |
|---|---|---|---|
| 1,743,758 | 1/1930 | Cobb | 251/324 |
| 2,464,024 | 3/1949 | Carter et al. | 242/46.2 |
| 2,705,111 | 3/1955 | Bruestle | 242/46.2 |
| 3,352,316 | 11/1967 | Zahn | 251/320 |
| 3,495,781 | 2/1970 | Graf et al. | 242/46.4 |
| 3,841,574 | 10/1974 | Lenk | 242/46.4 |

FOREIGN PATENT DOCUMENTS

| | | | |
|---|---|---|---|
| 2,039,913 | 2/1971 | Germany | 242/36 |

*Primary Examiner*—Richard E. Aegerter
*Assistant Examiner*—John W. Shepperd
*Attorney, Agent, or Firm*—Kenyon & Kenyon, Reilly, Carr & Chapin

[57] ABSTRACT

The bobbin chuck is provided with a pneumatically operated bobbin tube holding means and is arranged to be pivoted against a brake shoe to be braked to a standstill. The brake shoe is pivotally mounted about a remote axis and is movable radially of this axis when engaged by the rotating bobbin chuck. The brake shoe has a push-off piston which closes off a pneumatic connection from a pressurized chamber in the brake shoe and the bobbin tube holding means as the brake shoe is pivoted under the braking momentum generated by the bobbin chuck during braking. After braking and disappearance of the braking momentum, the pressure in the pressure chamber causes the brake shoe to pivot in the opposite direction and thus opens the pneumatic connection to the bobbin tube holding means. The tube is then released.

12 Claims, 4 Drawing Figures

METHOD AND APPARATUS FOR BRAKING A BOBBIN CHUCK AND FOR RELEASING A BOBBIN TUBE THEREON

This invention relates to a method and apparatus for braking a bobbin chuck and for releasing a bobbin tube thereon.

Various types of devices have been known for braking bobbin chucks and for holding and releasing bobbin tubes on the bobbin chucks. For example, Swiss Patent 495,907 U.S. Patent 3,701,492 describes a structure in which a bobbin chuck is pivoted against a brake lever which, in turn, is pivotable about a fixed axis to activate a switching function. The bobbin chuck is pivoted in such a manner that a braking force component is generated to prevent a pivoting movement of the brake lever which would activate the switching function until the bobbin chuck is brought to a standstill. After braking to a standstill, the brake lever is pivoted under the influence of the contacting force of the bobbin chuck in such manner that the switching function of the brake lever is effected along with a release of a bobbin tube clamped on the bobbin chuck. In this arrangement, if fast bobbin changes are effected, hard and undampened shocks are generated which detrimentally influence the bobbin package and the bearings. Furthermore, this arrangement is not satisfactory if automatic bobbin change devices are used (which use is increasingly widespread today) because, in addition to a reliable bobbin braking action, an extremely precise positioning of the bobbin chuck axis is required. However, this cannot be achieved by using a device of the previously known type as the position of the bobbin chuck axis depends on the degree of wear of the brake linings.

Also, at increased delivery speeds, or at increased winding speeds of winding devices, the downtime for the bobbin change process must be kept as low as possible if expensive waste of already processed threads is to be avoided.

Accordingly, it is an object of the invention to effect a soft contact shock of the bobbin chuck on the brake lining and to bring the bobbin chuck into a precisely predetermined position, combined with a reliable braking action to a complete standstill before the bobbin tube is released.

It is another object of the invention to provide a simple reliable procedure for braking bobbin chucks to a standstill and for releasing bobbin tubes clamped thereon after stopping.

It is another object of the invention to use the braking momentum of a bobbin chuck to control a bobbin release operation.

Briefly, the invention provides an apparatus and method in which a bobbin chuck is braked to a standstill before a releaseable bobbin tube holding means of the chuck is activated to release a bobbin tube thereon.

The apparatus provides a combination of elements including a rotatable bobbin chuck having a means for releasably holding a bobbin tube thereon, a brake shoe having a brake lining facing a cylindrical surface of the bobbin chuck, means for pivotally the brake shoe about a pivot axis coaxial of the bobbin chuck when the chuck is in braking engagement with the brake shoe, means for guiding the brake radially of the pivot axis when the bobbin chuck comes into contact with the brake shoe, a pneumatic system connected to the bobbin tube holding means over the brake shoe for pneumatically operating the holding means to release a bobbin tube, and a control means in the brake shoe for controlling delivery of pressure medium to the holding means.

The means for pivoting the brake shoe may be in the form of a lever which is mounted to pivot on the pivot axis of the brake shoe while the means for guiding the brake shoe radially of this axis may include a dependent piston on the lever and a cooperating pressure chamber in the brake shoe by which the brake shoe may slide on the piston.

The pneumatic system includes a suitable means which communicates the pressure chamber with source of pressurized gas, such as air, and a connection, including a bore, in the brake shoe which communicates the pressure chamber with the bobbin tube holding means. The control means is in the form of a piston slidably mounted in a slide chamber located in a side of the brake shoe so that the piston is disposed in the direction of brake shoe rotation, i.e. in the direction in which a rotating bobbin chuck rotates. This piston cooperates with an abutment outside the brake shoe and with the bore so as to close the bore and, thus, the connection to the bobbin tube holding means, when in a retracted position and to open the bore, and thus the connection when in an extended position.

In accordance with the method of the invention, a rotating bobbin chuck is moved in a first direction against the brake lining. The engaged brake shoe and bobbin chuck are then moved in the same direction during continued movement of the brake shoe. This causes the pressure in the pressure chamber of the brake shoe to increase due to the plunger effect of the piston therein. Also, during this time, as the bobbin chuck is being braked to a standstill, the brake shoe is pivoted about the remote pivot axis under a braking force component perpendicular to the first direction of movement which is applied to the brake lining. This braking force component is sufficient to overcome the pneumatic force on the piston in the side of the brake shoe. As a result, the piston remains in a retracted position in the side of the brake shoe and closes the connection to the bobbin tube holding means. This prevents release of a bobbin tube. Thereafter, when the braking force disappears, the brake shoe is pivoted in the opposite direction under the pneumatic force generated in the pressure chamber so as to open the connection to the bobbin tube holding means and thus simultaneously impose the pneumatic force on the holding means to release a bobbin tube.

These and other objects and advantages of the invention will become more apparent from the following detailed description taken in conjunction with the accompanying drawings in which.

Figure 1:
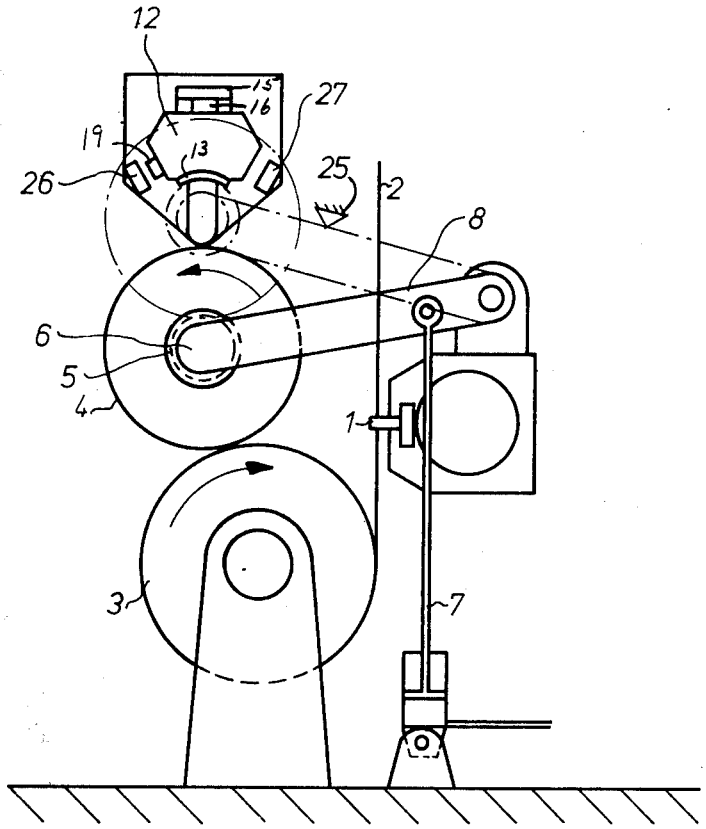
FIG. 1 illustrates a schematical side view of a winding device according to the invention.

Referring to FIG. 1, the winding device includes a thread traversing device 1 which moves a delivered thread 2 to and fro according to a desired traversing motion in such manner that the thread 2 contactingly moves on a driven friction drive drum 3 until being wound upon a bobbin package 4 which contacts the friction drive drum 3. The bobbin package 4 is wound onto a detachable bobbin tube 5 which in turn is placed on a bobbin chuck 6 which is supported by a pivotable arm 8 (FIG. 1) pivotally mounted on the frame and pivotably connected with a lift-off device 7.

Figure 2:
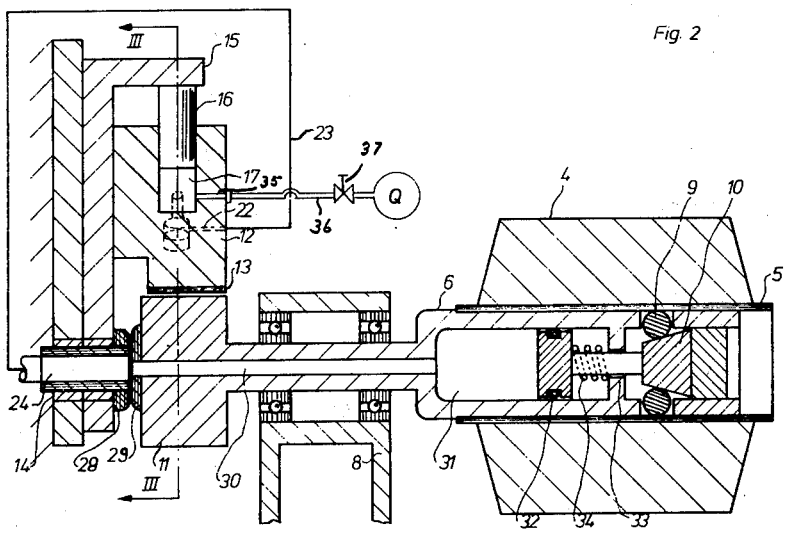
FIG. 2 illustrates a longitudinal sectional view of a bobbin chuck with a brake shoe according to the invention.

Referring to FIG. 2, during operation, the bobbin tube 5 is held on the bobbin chuck 6 by a releasable holding means, such as an expendable clamping ring 9 which is pressed radially towards the outside by a cone 10 under the influence of an axially acting spring force. Other bobbin tube holding means and release mechanisms may also be used such as those described in U.S. Pat. Nos. 3,820,739 and 3,554,455. The opposite end of the bobbin chuck 6 carries a cylindrical surface in the form of a cylinder 11 for contacting a brake shoe 12 lined with a brake lining 13.

The brake shoe 12 is pivotally mounted by a means such as a pivotable element or support 15 which can pivot about a fixed hub 14 in the winding device frame. In addition, the brake shoe 12 is guided radially of the hub 14 by means of a piston 16 which is rigidly connected to the pivotable element 15 in dependent fashion. To this end, the brake shoe 12 includes a cylindrical space 17 to slideably receive the piston 16 which space 17 also acts as a pressure chamber.

A pneumatic system is connected to the releaseable bobbin tube holding means over the brake shoe 12 for penumatically operating the holding means to release the bobbin tube 5. This pneumatic system includes a passage 35 in the brake shoe 12 which communicates the pressure chamber 17 with a permanent source of compressed air Q via a suitable conduit 36 containing a control valve 37. In addition, the pneumatic system includes a connection to the bobbin chuck which includes a bore 18 in the side of the brake shoe 12 which is connected to the pressure chamber 17 via a duct 20, a pressure chamber 21 within the bore 18, a bore 22 in the side wall of the bore 18 which communicates with a connecting hose 23 on the exterior of the brake shoe and a bore 24 defined by a sleeve extending through the hub 14. The bore 24 is disposed on an axis which is coaxial with the axis of the bobbin chuck 6 when the chuck 6 engages the brake shoe 12. To this end, an annular nozzle 28 of rubber material is mounted on the sleeve defining the bore 24 to form a counter-piece to an end piece 29 on the bobbin chuck 6 containing a bore. An axial bore 30 in the bobbin chuck 6 connects a chamber 31 with the end piece 29 in such a manner that during the winding operation the pressure of the surrounding atmosphere prevails in the chamber 31. The chamber 31 is sealed at one end of the bobbin chuck by a piston 32 which is connected via a piston rod 33 with the cone 10. During the winding operation, a coil spring 34 presses the cone 10 into the expandable clamping ring 9 to expand the ring 9 against the bobbin tube 5 in such a manner that the tube is held fixed.

Figure 3:
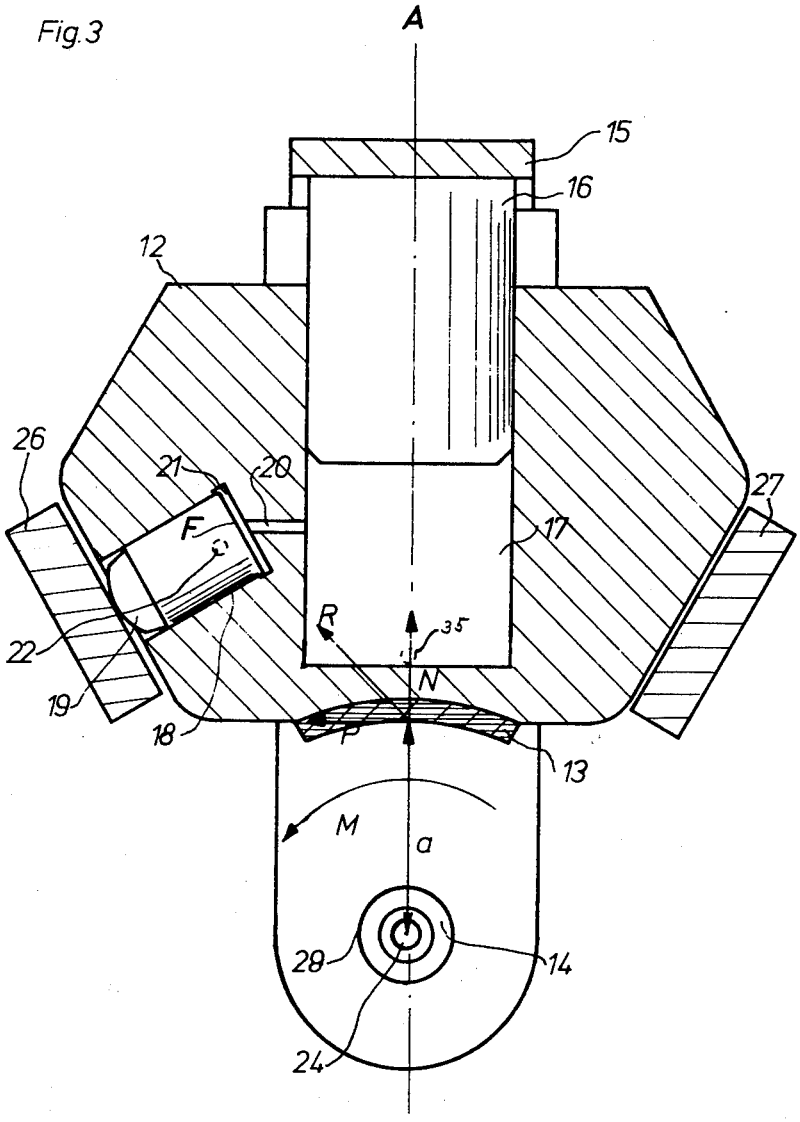
FIG. 3 illustrates a cross-sectional view of a detail of the brake shoe taken on line III — III of FIG. 2 in a position during the winding process.
Figure 4:
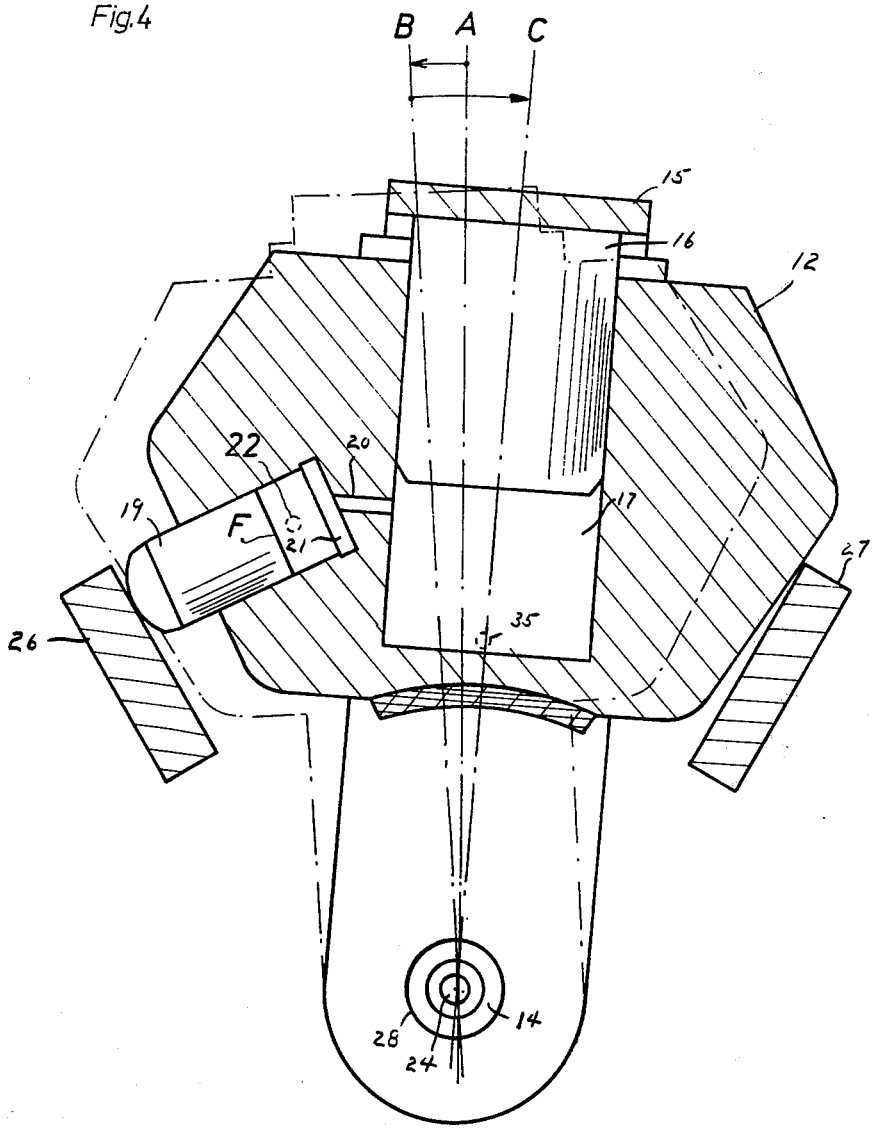
FIG. 4 illustrates a view similar to FIG. 3 but after the standstill of the bobbin chuck.

Referring to FIG. 3, a control means in the form of push-off piston 19 is mounted in the bore 18 to slide between a retracted position and an extended position (FIG. 4). The piston 19 cooperates with one abutment 26 of a pair of abutments 26, 27 which serve to limit rotation of the brake shoe 12 about the pivot axis, i.e. about the hub 14. As shown, the bore 18 acts as a slide chamber for the piston 19 while the pressure chamber 21 is located between the duct 20 and piston 19. In addition, in the retracted position, the piston 19 closed the bore 22 while in the extended position, the piston 19 opens the bore 22 to the pressure chambers 20, 17.

Referring to FIG. 2, when the pivoting arm 8 is in a pivoted-up position, i.e. during the braking process (position indicated with dash-dotted lines in FIG. 1), the bobbin chuck 6 is placed coaxial with the hub 14 on the brake; a stop 25 rigidly arranged on the frame of the winding device ensuring the coaxiality of the hub 14 and th bobbin chuck 6. The pivoting movement of the pivotable element 15, or of the brake show 12 respectively, is limited by the two laterally provided stops 26, 27.

A bobbin change is effected in the following manner.

During the package build of the bobbin package 4, the pressure chamber 17 of the brake shoe 12 is connected with the source Q of compressed air and the brake shoe 12 is placed in a moved out position A (FIG. 3). The effective surface F of the push-off piston 19 is dimensioned in such a manner that the force of the push-off piston 19 is smaller than the force component of the brake shoe 12 acting in the same direction. Thus, the piston 19 remains pressed against the stop 26 and thus remains in the retracted position during the winding operation owing to the greater force of the brake shoe 12. The brake shoe 12 also rests against the stop 27 on the side opposite to the push-off piston 19.

As the lift-off device 7 is activated, the bobbin chuck 6 including the bobbin tube 5 and the full bobbin package 4 are lifted off the friction drive drum 3 and are pivoted towards the brake lining 13, the pivoting movement of the bobbin chuck 6 being limited by the stop 25. As the cylinder 11 engages the brake lining 13, the brake shoe 12 is moved upwardly as viewed along the guide piston 16 radially of the pivot axis of the brake shoe 12. The compressed air in the pressure chamber 17 is then repressed into the pressure source Q. However, owing to the reaction of the braking force, acting in the circumferential direction, a braking force component generates a momentum M which acts on the pivotable element 15 in such a manner that the push-off piston 19 in the bore 18 of the brake shoe 12 remains in the retracted position. The relation $M = P \times a$ prevails, where P is the friction force (i.e. braking force component) and $a$ is the distance between the pivot axis of the pivotable element 15 and the point of action of the force P, N being the normal force of the cylinder 11 acting on the brake shoe 12. The braking shoe 12 thus takes the position B as indicated in dash-dotted lines in FIG. 4.

Simultaneously with the pivoting movement of the bobbin chuck 6 to the braking position, the end piece 29 is brought into coaxial position with the nozzle 28 and an airtight connection between the two elements 28, 29 is established (FIG. 2). As the bobbin chuck 6 comes to a complete standstill, the braking momentum M acting onto the brake shoe 12 disappears. The push-off piston 19 can now be pushed outwards, i.e. extended relative to the slide chamber 18, by the pressure prevailing in the chambers 21, 17 in such a manner that the pivotable element 15 is pivoted against the abutment 27 into the position C indicated with solid lines in FIG. 4. The bore 22 is thus uncovered and a connection is established between the pressure chamber 17 via the duct 20 and the opening 22 with the chamber 31. The increase of the pressure in the chamber 31 pushes the piston 32 including the piston rod 33 and the cone 10 towards the right hand side as viewed in such a manner that the expandable clamping ring 9 releases the bobbin tube 5.

After the full bobbin package is doffed and a new bobbin tube is donned, the pivoting arm 8 again moves the bobbin chuck 6 towards the friction drive drum 3.

As the bobbin chuck 6 pivots away from the brake shoe 12, the supply of compressed air to the chamber 1 is interrupted and the bobbin tube 5 again is fixed on the bobbin chuck 6 by the spring 34 and the cone 10.

The invention thus provides a system in which a brake shoe is radially shifted under the influence of the contacting force of a bobbin chuck and, at the same time, is subject to a first rotational movement in the direction of the braking momentum by the generated braking momentum in order to prevent release of a bobbin tube and in which a second rotational movement of the brake shoe in the opposite direction is effected by compressed air after the braking momentum has disappeared, the same compressed air also effecting the release of the bobbin tube clamping action after the bobbin chuck has come to a complete standstill.

The brake shoe 12 permanently supplied with compressed air from the source Q os compressed air has proven especially advantageous. For example, no hard shock and no high momentaneous deceleration act on the bobbin package 4 while the bobbin 6 is rapidly pivoted to the brake lining 13, which could otherwise shift the bobbin package 4 in itself or on the bobbin tube 5. By varying the pressure of the source Q of compressed air, the braking momentum can easily be adjusted to the type of package build, to the fiber material processed and to the brake lining material used. Further, the degree of wear of the brake lining 13 does not influence the correct function of the apparatus.

What is claimed is:

1. In combination a machine frame;

a stop mounted on said frame;

a friction drive drum;

a rotatable bobbin chuck pivotally mounted on said machine frame for movement towards and away from said drum, said chuck including a releaseable bobbin tube holding device;

a brake shoe including a bore therein;

means for moving said chuck towards said brake shoe;

means pivotally mounting said brake shoe about a fixed axis on said machine frame;

means in said bore for guiding said brake shoe radially of said axis and to define a pressure chamber;

pneumatic means for supplying pressurized gas to said chamber of said brake shoe;

a connection between said pressure chamber and said bobbin tube holding device for supplying pressurized gas to said holding device to release a bobbin tube thereon; and a push-off piston mounted in said brake shoe and disposed in a direction tangential of brake shoe rotation about said fixed axis facing said stop, said piston being slidably disposed in a cylinder in communication with said chamber to selectively close said connection during a winding operation to prevent release of said bobbin tube holding device and open said connection upon stoppage of said bobbin chuck to release said holding device.

2. The combination as set forth in claim 1 which further includes a hollow hub coaxial of said axis and having said brake shoe mounted thereon, said bobbin chuck having a passage disposed coaxially of said hub with said bobbin chuck in a braking position against said brake shoe and said connection being connected to said hub to deliver pressurized gas thereto.

3. The combination as set forth in claim 1 wherein said pneumatic means includes a pneumatic source of compressed air.

4. In combination, a rotatable bobbin chuck including means for releaseably holding a bobbin tube thereon;

a support pivotally mounted about a fixed axis, said support having a piston mounted thereon;

a brake shoe slidably mounted on said piston radially of said axis, said brake shoe having a bore receiving said piston therein and being connectable to a source of pressurized gas;

a pair of fixedly mounted stops, each said stop being disposed on an opposite side of said brake shoe to limit pivoting of said brake shoe;

means for moving said bobbin chuck with said bobbin tube into frictional engagement with said brake shoe while moving said brake shoe radially away from said axis;

a push-off piston slidably mounted with a second bore of said brake shoe on a side of said brake shoe disposed in the direction of rotation of said bobbin chuck, said push-off piston being disposed in facing relation to one of said stops and said second bore being in communication with said pressure chamber to receive pressurized gas therefrom; and a connection between said second bore and said bobbin chuck for delivering pressurized gas from said second bore to said bobbin chuck for deactivating said means for releaseably holding a bobbin tube thereon, said connection having a third bore in said second bore disposed for selective closing by said push-off piston during braking of said bobbin chuck on said brake shoe and pivoting of said brake shoe towards said one abutment and opening upon stopping of said bobbin chuck and pivoting of said brake shoe away from said one abutment under the force of a pressurized gas in said second bore.

5. The combination as set forth in claim 4 wherein said means for releaseably holding a bobbin tube includes an expandable clamping ring, a cone for expanding said ring outwardly, a pressure chamber in said bobbin chuck, a piston slide ably mounted in said chamber and connected to said cone and a spring in said chamber biasing said piston in a direction to cause said cone to expand said ring; and wherein said pressure chamber in said bobbin chuck communicates with said connection when said bobbin chuck engages said brake shoe.

6. A brake shoe for a rotatable bobbin chuck having a pneumatically operated means for holding a bobbin tube thereon, said brake shoe including a bore adapted to receive a piston to define a pressure chamber, said bore being connectable to a source of pressurized gas;

a brake lining; a slide chamber located in a side of said brake shoe and in communication with said bore a piston slidably mounted within said slide chamber; and a second bore communicating with a side wall of said slide chamber and the exterior of said brake shoe whereby said piston closes said bore in a retracted position thereof within said slide chamber and opens said bore in an extended position thereof relative to said slide chamber to deliver pressurized gas from said pressure chamber through said bore to the pneumatically operated means of the bobbin chuck.

7. The combination of a brake shoe as set forth in claim 6 and means for pivoting said brake shoe about a fixed axis remote from said brake shoe, said means including a piston slidably received in said pressure chamber for guiding said brake shoe radially of said axis.

8. The combination as set forth in claim 7 which further comprises a pair of abutments for limiting pivoting of said brake shoe about said axis, said piston within said slide chamber being disposed in facing relation to one of said abutments.

9. A winding apparatus comprising a friction drive drum;

a rotatable bobbin chuck including means for releaseably holding a bobbin tube thereon and a cylindrical surface spaced from said means;

a pivotally mounted arm rotatably supporting said bobbin chuck thereon;

a lift-off device for pivoting said arm to move said bobbin between a first position for contact of said drive drum with a yarn package on a bobbin tube on said bobbin chuck and a second position;

a brake shoe having a brake lining facing said cylindrical surface of said chuck, a cylindrical interior bore and a second bore in communication with said first bore;

means for pivoting said brake shoe about an axis, said axis being coaxial of said cylindrical surface when said bobbin chuck is in braking engagement with said brake shoe in said second position;

stops laterally of said brake shoe for limiting pivotal movement of said brake shoe;

a piston in said first bore for guiding said brake shoe radially of said axis and for defining a pressure chamber;

a pneumatic means connected to said pressure chamber to supply pressurized gas thereto;

means including a duct in said brake shoe for communicating said pressure chamber with said bobbin chuck to pneumatically actuate said holding means in said bobbin chuck; and a piston slidably mounted in said second bore in said brake shoe and facing one of said stops to selectively cover said duct to interrupt a flow of pressurized air to said bobbin chuck.

10. An apparatus for winding yarn on a bobbin tube comprising a rotatable bobbin chuck having a holding means for releaseably holding a bobbin tube thereon;

a brake shoe having a brake lining facing a cylindrical surface of said chuck;

means for pivoting said brake shoe about a pivot axis coaxial of said bobbin chuck when said chuck is in braking engagement with said brake shoe stops laterally of said brake shoe for limiting pivotal movement of said break shoe;

means for guiding said brake shoe radially of said pivot axis when said chuck comes into contact with said brake shoe;

a pneumatic system connected to said holding means for pneumatically operating said holding means to release a bobbin tube said pneumatic system including a bore in said brake shoe for conveying pressurized air to said bobbin chuck;

a control means in said brake shoe for controlling delivery of pressure medium to said holding means said control means including a piston slidably mounted in said brake shoe and facing one of said stops to selectively cover said bore to interrupt a flow of pressurized air to said bobbin chuck.

11. A method of braking a rotating bobbin chuck on a pivotally mounted brake shoe having a brake lining thereon and of releasing a bobbin tube clamped on the chuck by a releaseable holding means, said method comprising the steps of moving the rotating bobbin chuck in first direction against the brake lining of the brake shoe and moving the engaged brake shoe in the same direction with the bobbin chuck during continued movement of the bobbin chuck in said direction;

pivoting the brake shoe about an axis remote from the brake shoe under a braking force component perpendicular to said first direction and applied to the brake lining of the brake shoe while braking the bobbin to a standstill; and thereafter pivoting the brake shoe in an opposite direction about said axis under a pneumatic force while simultaneously imposing the pneumatic force on the releasable holding means of the bobbin chuck to release the bobbin tube.

12. A method as set forth in claim 11 wherein the brake shoe is pneumatically pressed towards the bobbin chuck during engagement under a variably set air pressure and said braking force component is variable in response to changes in said air pressure.

* * * * *

UNITED STATES PATENT AND TRADEMARK OFFICE

CERTIFICATE OF CORRECTION

PATENT NO. : 4,036,446

DATED : July 19, 1977

INVENTOR(S) : Hugo Schar

It is certified that error appears in the above-identified patent and that said Letters Patent are hereby corrected as shown below:

Column 1, line 61, after "pivotally" insert -- mounting --

Line 64 after "brake" insert -- shoe --

Column 3, line 57 after "of" insert -- a --

Line 66 change "closed" to -- closes --

Column 4, line 7, change "th" to -- the --

Line 8 change "show" to -- shoe --

Column 5, line 2, change "l" to -- 31 --

Line 18 change "os" to -- of --

Column 6, line 20, change "with" to -- within --

Line 43 change "slide ably" to -- slideably --

Line 62 before "bore" insert -- second--

Line 64 before "bore" insert - second --

Line 66 before "bore" insert -- second --

Column 7, lines 4 to 5 change "pressure chamber " to -- bore --

Column 8, line 9, change "break" to -- brake --

UNITED STATES PATENT AND TRADEMARK OFFICE

CERTIFICATE OF CORRECTION

PATENT NO. : 4,036,446

DATED : July 19, 1977

INVENTOR(S) : Hugo Schar

It is certified that error appears in the above-identified patent and that said Letters Patent are hereby corrected as shown below:

Line 17 after "chuck;" insert -- and --

Line 29 after "in" insert -- a --

Signed and Sealed this

Tenth Day of January 1978

[SEAL]

*Attest:*

RUTH C. MASON
*Attesting Officer*

LUTRELLE F. PARKER
*Acting Commissioner of Patents and Trademarks*